US006032309A

United States Patent [19]

Michelson

[11] Patent Number: 6,032,309

[45] Date of Patent: Mar. 7, 2000

[54] ADJUSTABLE SURGICAL FRAME AND UNIVERSAL RAIL CLAMP

[76] Inventor: Gary Karlin Michelson, 438 Sherman Canal, Venice, Calif. 90291

[21] Appl. No.: 08/389,077

[22] Filed: Feb. 14, 1995

Related U.S. Application Data

[63] Continuation of application No. 08/108,885, Aug. 18, 1993.

[51] Int. Cl.[7] ..... A47B 7/00; A47C 20/00; A61G 13/12

[52] U.S. Cl. ..... 5/621; 5/630; 5/632; 5/646; 128/845

[58] Field of Search ..... 128/870, 869, 128/871, 845; 606/241, 240, 237; 5/621, 624, 648; 601/24

[56] References Cited

U.S. PATENT DOCUMENTS

| | | | |
|---|---|---|---|
| 3,643,938 | 2/1972 | Levasseur | 606/241 |
| 4,391,438 | 7/1983 | Heffington, Jr. | 5/621 |
| 4,481,943 | 11/1984 | Michelson | 128/134 |
| 4,583,725 | 4/1986 | Arnold | 5/621 |
| 4,824,089 | 4/1989 | Dickhudt et al. | 5/621 |
| 4,908,892 | 3/1990 | Michelson | 5/621 |

*Primary Examiner*—Michael O'Neill
*Attorney, Agent, or Firm*—Martin & Ferraro LLP

[57] ABSTRACT

The adjustable surgical frame of the present invention comprises two side frame members made from rectangular rods forming closed loop, disposed in parallel and spaced apart relationship that provides the surgical frame with the predominate portion of its structural integrity. The configuration of the side frame members is such that the base portion of each side frame member is substantially narrower than the base portions of the surgical frames of the past. The reduced width of the base portion permits the surgical frame of the present invention to be placed closer to the end of the operating table without diminishing the strength and stability of the surgical frame. The side frame members are configured so as not to interfere with the area near the wound and permit the placement of peripheral surgical equipment, such as an instrument stand, adjacent to the wound site and level with the patient's back.

24 Claims, 5 Drawing Sheets

ADJUSTABLE SURGICAL FRAME AND UNIVERSAL RAIL CLAMP

This application is a continuation of application Ser. No. 08/108,885, filed on Aug. 18, 1993.

BACKGROUND OF THE INVENTION

1. Field of the Invention

This invention relates to surgical positioning devices, and more particularly to an adjustable surgical frame to support and stabilize a patient to facilitate spinal surgery.

2. Description of the Related Art

During orthopedic surgery, when the lumbar spine is to be operated on, the patient must be placed in a position which takes pressure off the chest cavity and the abdomen. One commonly used position is the modified knee-chest position where the knees of the patient are not actually positioned against the chest but rather are bent to a right angle with the hips similarly bent to a right angle. A special positioning device is required to maintain a patient in this modified knee-chest position.

One such device was developed by Michelson, U.S. Pat. No. 4,481,943 ('943) issued on Nov. 13, 1984. The '943 patent discloses a surgical frame for use during surgery to position a patient in the modified knee-chest position and reduce the tension on the neural structures during surgery. While the surgical frame of the '943 patent had its advantages, certain short comings became known during its use.

One problem experienced during the use of the '943 frame was that the patient was positioned relatively high with respect to a surgeon of average height. When the '943 frame was placed on an operating table, it sat relatively high on the operating table requiring the surgeon and his assistants to stand on a raised platform or other supporting surface during surgery in order to access the spine of the patient. This set up was relatively dangerous because the surgeon or the assistants could fall from the platform and injure themselves or the patient during the operation. Moreover, the '943 frame could not be adjusted to position the patient in an adequate lowered position to facilitate access to the lumbar spine for a surgeon of average height, especially for taller patients.

Another problem encountered with the '943 frame was that the '943 frame was too bulky and heavy which created problems in storing and transporting the frame. Although the '943 frame had legs with a roller mechanism, the roller mechanism would become impeded by the normal dust and wax present on the operating room floor and would prevent the '943 frame from being rolled so that it had to be carried. Yet another problem encountered by the '943 frame was that it was not attachable to the various types of operating tables used in surgery because it was not adaptable to fit the differing side rail dimensions and inter-rail widths of the various operating tables used in spinal surgery.

A further problem with the '943 frame was that the top portion of its side frame members extended above the level of the patient's spine and would interfere with the area near the wound of the patient, so that during surgery, the surgeon would have to work around the top portion of the side frame members. The top portion of the side frame members would also prevent the use of the '943 frame with peripheral surgical equipment such as an instrument stand, which is normally placed adjacent to the wound site so that a flat working surface adjacent to the wound and level with the height of the spine of the patient is created.

SUMMARY OF THE INVENTION

The present invention is an adjustable surgical frame for positioning and maintaining a patient in a modified knee-chest position during spinal surgery. The adjustable surgical frame of the present invention comprises two side frame members made from rectangular rods forming a closed loop, disposed in parallel and spaced apart relationship that provide the surgical frame with the predominate portion of its structural integrity. The configuration of the side frame members is such that the base portion of each side frame member is substantially narrower than the base portions of the surgical frames of the past. The reduced width of the base portion permits the surgical frame of the present invention to be placed closer to the end of an operating table so that the patient is also placed closer to the end of the operating table without diminishing the strength and stability of the surgical frame. The side frame members are configured so as not to interfere with the area near the wound and permit the placement of peripheral surgical equipment, such as an instrument stand, adjacent to the wound site and level with the patient's back.

The adjustable surgical frame of the present invention is removably mountable to an operating table by a plurality of pivoting mounting legs pivotally attached to the bottom of the surgical frame. The pivoting legs each have an attachment post that is off-set from the pivotal attachment point of each pivoting leg on the bottom of the surgical frame. The off-set orientation of each attachment post enables the user of the surgical frame of the present invention to alter the position of the attachment posts by simply swiveling the surgical frame about the pivoting legs. As a result, the attachment posts may be positioned so that they may be easily attached to a variety of conventional operating tables having different widths and different distances between the rails located at the sides of the operating tables.

Also, the surgical frame of the present invention may be swiveled about the pivoting legs to extend a portion of the surgical frame past the end of an operating table so that the surgical frame is cantilevered off the end of the operating table. In the cantilevered position, when the operating table is tilted in a reversed 45 degree angle, the surgical frame of the present invention is in a much lower position than was possible with the surgical frames of the past. As a result, the height of the patient being supported by the surgical frame is lower than previously possible and the surgeon has better access to the patient's spine, eliminating the need for the surgeon and his staff to stand on a platform in order to reach the patient's spine during surgery.

Further, the pivoting legs of the surgical frame may be attached to the side rails of an operating table by a plurality of universal rail clamps that are adjustable to fit different types of side rails found in various operating tables currently in use. Each universal rail clamp used to attach the surgical frame of the present invention to an operating table has a universal socket at one end adaptable to attach to a variety of side rails of different sizes. The universal rail clamp is designed so that it may be tightened to secure the attachment post of a pivoting leg and attach to a side rail of an operating table simultaneously by the rotation of a single handle. This one step tightening saves time and facilitates the mounting and adjusting of the surgical frame onto an operating table.

In addition, the surgical frame of the present invention has self-locking, adjustable lateral supports to provide increased stability of the patient in the modified knee-chest position during is surgery. The lateral support panels of the surgical frame of the present invention are also removable and are attachable to the interior portion of the surgical frame to facilitate shipping and storage.

Finally, the surgical frame of the present invention is lighter and more compact than the surgical frames of the past so that it is easily transportable and may be easily stored.

OBJECTS OF THE PRESENT INVENTION

It is an object of the present invention to provide an adjustable surgical frame for use in surgery that has pivoting legs for supporting and mounting the adjustable surgical frame in different positions on an operating table by swiveling the frame about pivoting legs.

It is a further object of the present invention to provide an adjustable surgical frame for use in surgery that is universally mountable to the various types of operating tables.

It is another object of the present invention to provide a rail clamp for attaching the surgical frame to a operating table having a socket that is universally adaptable to fit a variety of operating tables having different sizes of side rails.

It is yet another object of the present invention to provide an adjustable surgical frame for use in surgery that can be cantilevered off one end of an operating table.

It is also an object of the present invention to provide an adjustable surgical frame for use in surgery that provides adjustable self-locking lateral supports for the hips of a patient during spinal surgery.

It is still another object of the present invention to provide an adjustable surgical frame for use in surgery with removable lateral support panels.

It is a further object of the present invention to provide an adjustable surgical frame that is light weight, compact and easy to store.

It is yet a further object of the present invention to provide an adjustable surgical frame for use in surgery that is compact, low profile and non-intrusive into the surgical field.

It is still a further object of the present invention to provide an adjustable surgical frame for use in surgery that has pivoting legs having an improved rolling means at the end of the pivoting legs.

These and other objects of the present invention shall be more clear upon review of the detailed description of the drawings and the accompanying drawings.

DETAILED DESCRIPTION OF THE DRAWINGS

Figure 1:
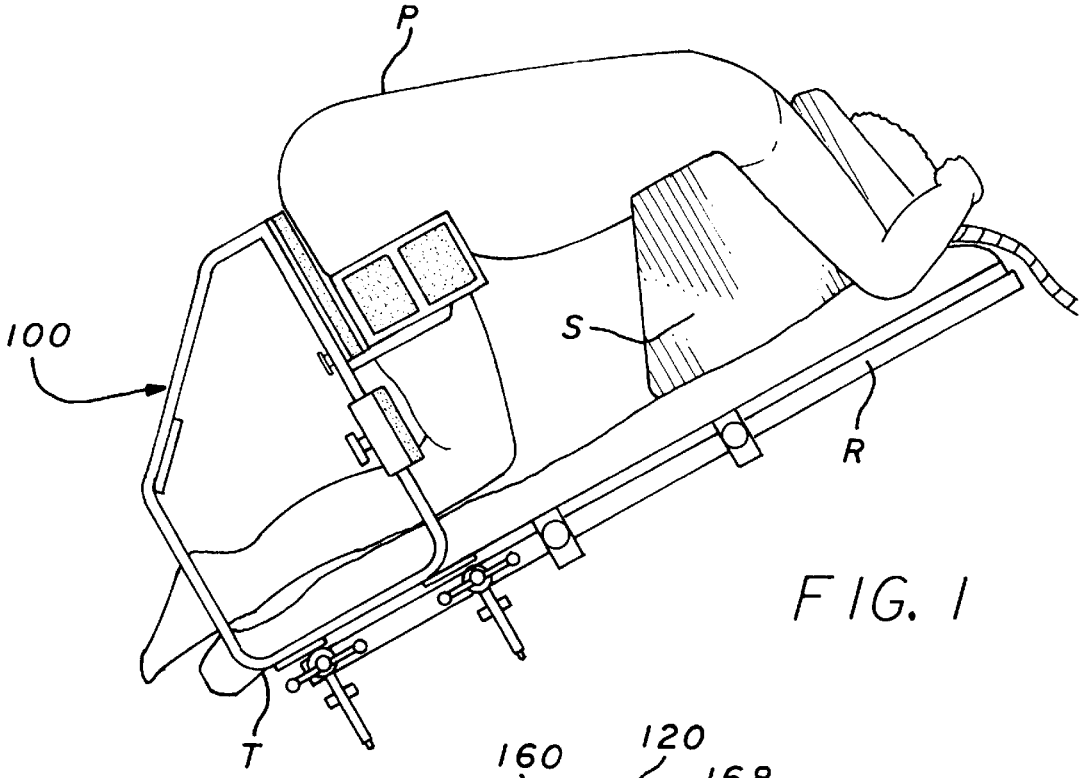
FIG. 1 is a lateral view of the adjustable surgical frame of the present invention mounted to an operating table, with a patient placed in a proper position thereon.
Figure 2:
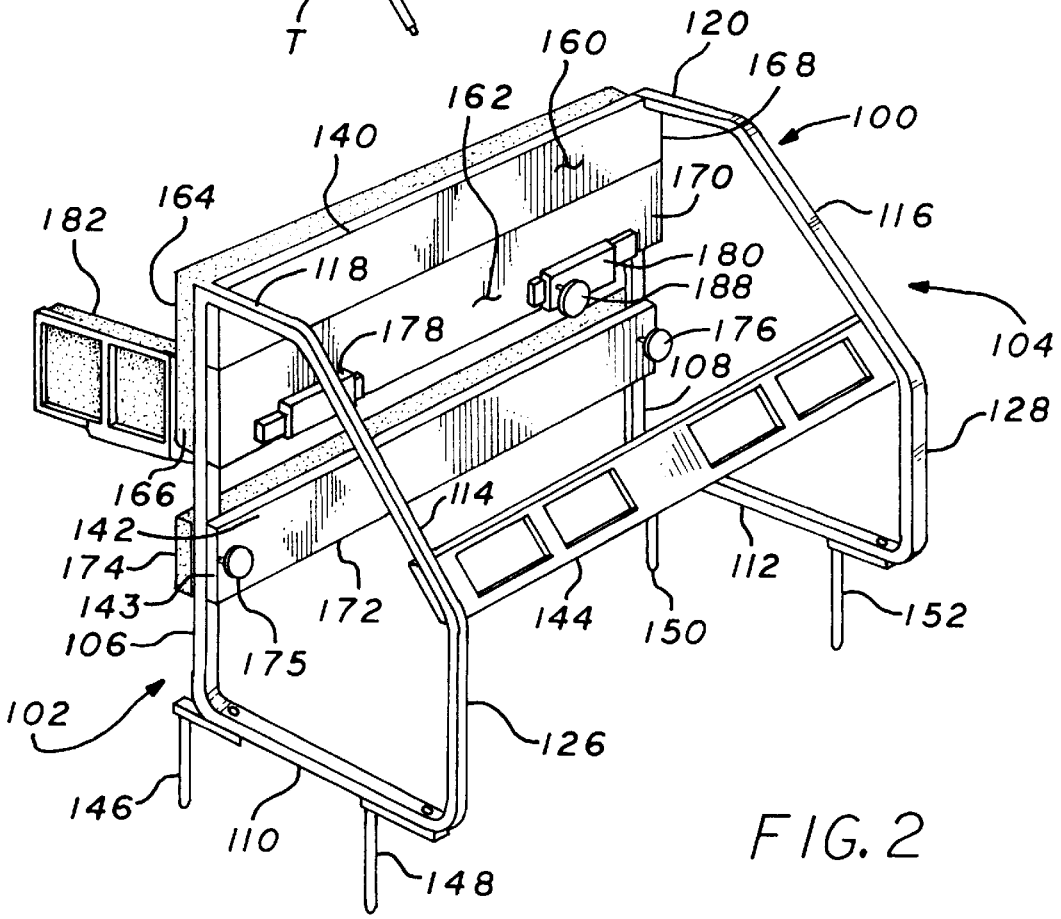
FIG. 2 is a rear perspective view of the adjustable surgical frame of the present invention.

Referring to FIGS. 1 and 2, the adjustable surgical frame 100 of the present invention is shown in use as contemplated. The patient P lies on the operating table in a hips-up, shoulders-down position. In order to accommodate the anesthetized patient P for an extended period of time, the operating table is tilted downwards to a reverse Trendelenburg position at approximately a 45 degree angle. At this angle, the patient's back is generally horizontal to the floor. The patient's arms are placed out of the way, as shown in FIG. 1.

As seen in FIG. 2, the surgical frame 100 has two side frame members 102,104 made from rectangular rods forming a closed loop that provide the surgical frame 100 with the predominate portion of its structural integrity. The side frame members 102,104 each have vertical front side rods 106,108, horizontal lower side rods 110,112, vertical rear side rods 126,128, angled rear side rods 114,116 and horizontal upper side rods 118,120.

The vertical front side rods 106,108 are substantially longer than the vertical rear side rods 126,128 and the horizontal lower side rods 110,112 are substantially longer than the horizontal upper side rods 118,120 so that the angular side rods 114,116 must be at an angle in order to connect the ends of the vertical front side rods to the vertical rear side rods.

In the preferred embodiment, the vertical front side rods 106,108 are each approximately 22 inches long, the vertical rear side rods 126,128 are each approximately 11 inches long, the horizontal lower side rods 110,112 are each approximately 12 inches long, the horizontal upper side rods 118,120 are approximately 3 inches long and the angular rear side rods 114,116 are each approximately 14 inches long.

In this configuration, the distance between the vertical front side rods 106,108 and the rear vertical side rods 126,128 is decreased to almost one half the distance that was present in the surgical frames of the past. In the preferred embodiment this distance is approximately 12 inches, equal to the length of the horizontal lower side rods 110,112. A major advantage of this configuration is that when the surgical frame 100 is positioned at the end of an operating table T, the surface of the surgical frame 100 that supports the posterior of the patient may be placed closer to the end of the operating table T and thus lowers the height of the patient's spine when the table is pitched 45 degrees. The closer to the end of the operating table that the patient is placed, the lower is the position of the patient's spine which gives better access to the surgeon, thus eliminating the need for a surgeon to stand on a stool or similar supporting device in order to access the spine of the patient in the modified knee-chest position. Another advantage that results from the reduced distance between the vertical front side rods 106, 108 and the vertical rear side rods 126,128, is that the surgical frame 100 is lighter while the overall strength and stability of the surgical frame is increased.

Connecting the two side frame members 102,104 between the vertical front side rods 106,108 are a padded horizontal major posterior support bar 140 and an adjustable minor posterior support bar 142. A rear cross bar 144 approximately 25½ inches long and 3 inches wide connects the angled rear side rods 114 and 116.

The major posterior support bar 140 serves to support the posterior of a patient and has an upper panel 160 and a lower panel 162. Both panels are approximately 25½ inches long and 4½ inches wide and span the distance between the two side frame members 102,104. The major posterior support bar 140 is bolted or otherwise rigidly attached to the side frame members 102,104.

The major posterior support bar 140 is attached to the side frame members 102,104 so that the upper panel 160 does not extend above the horizontal upper side rods 118,120. Each panel 160,162 of the major posterior support bar 140 has a padded outer side 164,166 and a metal inner side 168,170 which provides structural support to the surgical frame 100. The padded outer sides 164,166 are covered by a protective coating of FDA approved medical grade closed cell foam, although any gas-sterilizable, waterproof, bacteria resistant, non-toxic padding may be used.

The dual panel construction (upper and lower panels 160,162) provides increased strength to more rigidly support the posterior of the patient and adds stability to the surgical frame 100. In the preferred embodiment of the present invention, the upper and lower panels 160,162 are constructed of a 1.0 mm thick sheet metal, that has a 7.0 mm edge bent at a right angle to the rest of the panel throughout the perimeter of each panel. By having two panels, the middle of the major posterior support bar 140 corresponds to the junction of the upper and lower panels 160,162 where the bent edges of each panel are adjacent to each other and provide a section of sheet metal that is perpendicular to the plane of the panels 160,162 so that the middle of the major posterior support bar 140 better resists the forces exerted by a patient positioned on the surgical frame. Thus the middle area of the major posterior support bar 140, the area in which the patient comes into the most contact with, is more rigid and the overall stability of the surgical frame 100 is increased.

The minor posterior support bar 142 is similar in construction to the major posterior support 140 but comprises a single panel. A sturdy inner side 172 of minor posterior support bar 142 is covered by a padded outer side 174. The inner side 172 of the minor posterior support bar 142 also provides structural support to the surgical frame 100.

The minor posterior support bar 142 is adjustable and lockable as it slides up and down the front of the surgical frame 100 along vertical front side rods 106,108. The minor posterior support bar 142 has clamps 143,145 riveted on each end thereof for fixing the minor posterior support bar 142 on the vertical front side rods 106,108. The clamps 143,145 slidably surround the vertical front side rods 106, 108. However, any movable means capable of being repeatedly affixed in a locked position can be used in lieu of the clamps 143,145.

In order to lock the minor posterior support bar 142 in place, a pair of thumbscrews 175,176 are positioned at the ends of the minor posterior support bar 142 and are screwed into the threaded holes 122,124 of the minor posterior support bar 142. Thumbscrews 175,176 extend toward and ultimately come into contact with the front vertical side rods 106,108 of the side frame members 102,104. As the thumbscrews 175,176 engage the two side frame members 102, 104, they hold the minor posterior support bar 142 in place.

Figure 3:
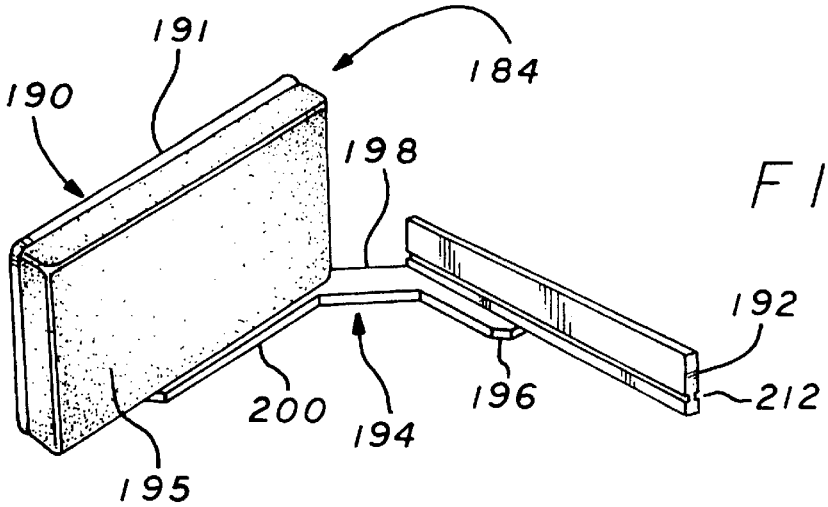
FIG. 3 is a view of the interior side of a lateral support panel of the adjustable surgical frame of the present invention.
Figure 4:
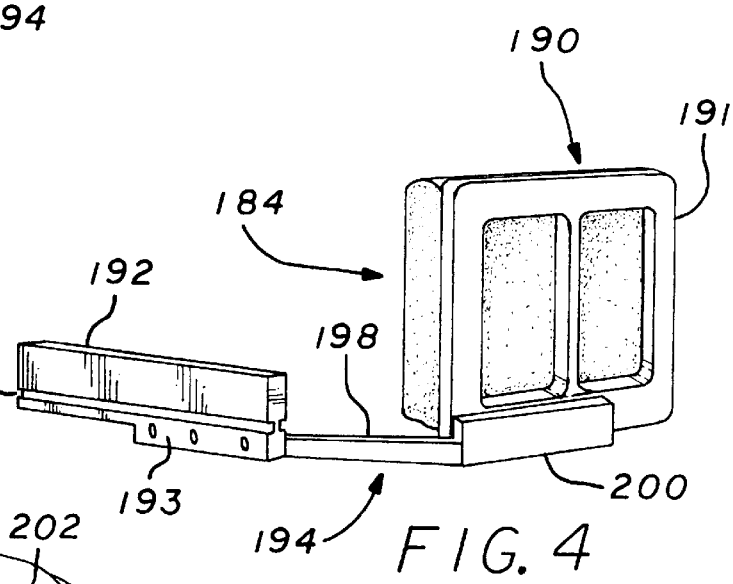
FIG. 4 is a view of the exterior side of a lateral support panel of the adjustable surgical frame of the present invention.

Shown in FIGS. 3 and 4, are lateral support panels 182,184 which are angular in nature. The lateral support panels 182,184 are mirror images of each other and the description of one also sets forth the description of the other.

Lateral support panel 184 has three basic components: a padded side support 190, a slotted attachment bar 192, and a transition bar 194 that mediates the distance between the padded side support 190 and the slotted attachment bar 192. The padded side support 190 comprises a rigid side support piece 191 made of metal and a side pad 195 affixed to the front of the side support piece 191. The side pad 195 is made from a high indentation force deflection foam covered by an outer cover. The padded side support 190 is spaced away from and is at a right angle to the attachment bar 192. The attachment bar 192 has a slot 212 along its length towards its lower edge, and has a lower portion 193 that is wider than the rest of the attachment bar 192.

The transition bar 194 is welded or bolted along the length of its back end 196 to the lower portion 193 of the attachment bar 192. The transition bar 194 angles away from the attachment bar 192 for a short distance along a middle portion 198, and then angles away from its middle portion 198 along the length of its front end 200. The front end 200 of transition bar 194 is attached along its length to the side support piece 191 of padded side support 190. The transition bar 194 is attached along its back end 196 and front end 200 in order to provide greater and more secure support for the patient P while the side support 184 panel is in use.

Figure 6:
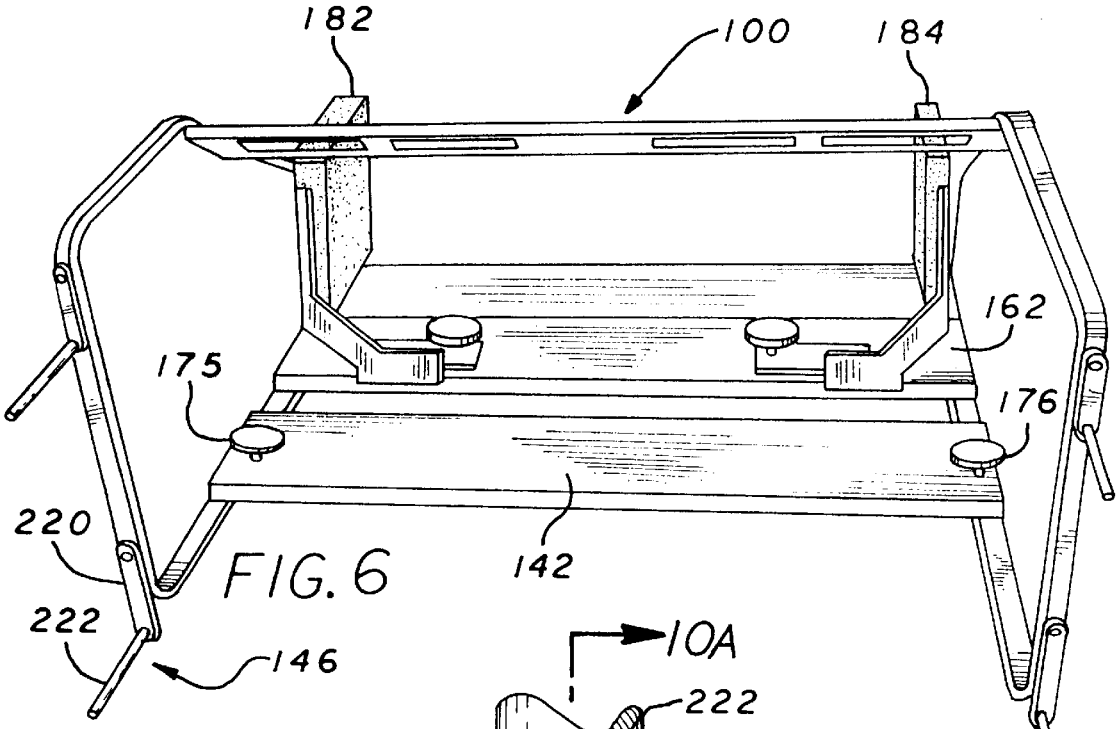
FIG. 6 is a bottom end view of the adjustable surgical frame of the present invention with the lateral support panels attached to the side facing away from the patient for shipping and storage purposes.

Referring to FIG. 6, located on the inner side 170 of the major posterior support bar 140 are two identical locks 178,180. The locks are positioned on the inner side 170 so that the two lateral support panels 182,184 can engage the locks 178,180. Thumbscrews 186,188 lock each of the lateral support panels 182,184 in place.

Figure 5:
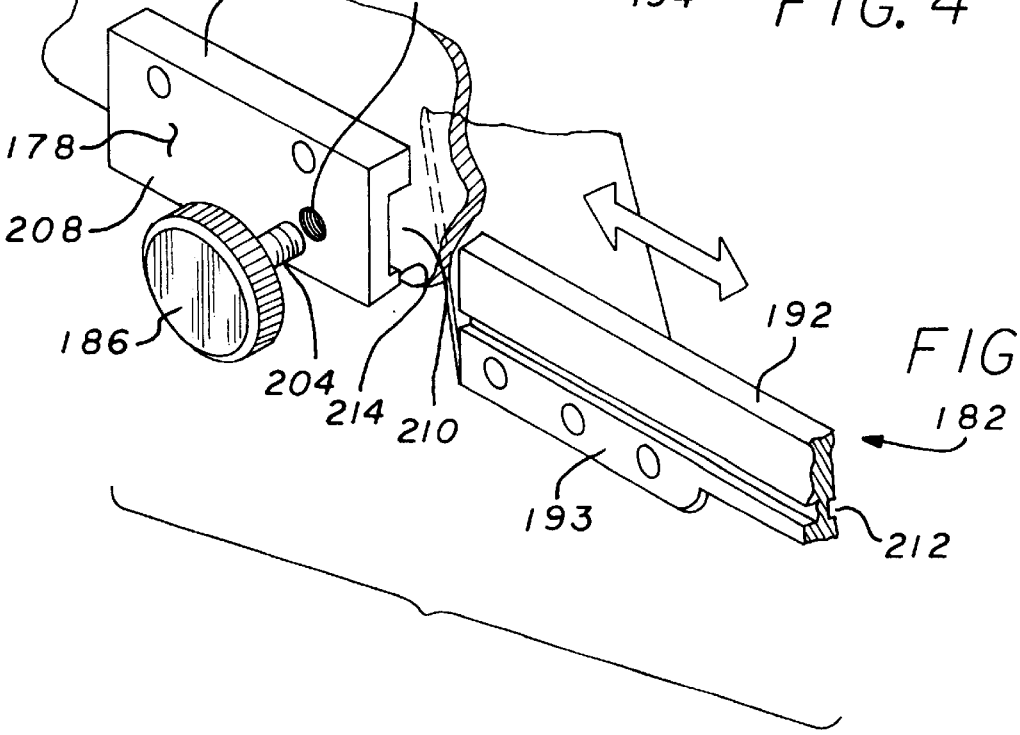
FIG. 5 is an exploded view of a locking mechanism for attaching the lateral support panel to the adjustable surgical frame of the present invention.

The lock 178 is shown in greater detail FIG. 5. The lock 178 has a threaded hole 202 at one end to receive the threaded screw portion 204 of thumbscrew 186. The top end 206 of the lock 178 extends away from the inner side 170 of the major posterior support bar 140 to provide space for the slotted attachment bar 192 of the side support 182. The main portion 208 of the lock 178 defines a space 210 between it and the inner side 170 of the major posterior support bar 140 that receives the portion of the attachment bar 192 above the slot 212. A slot runner 214 projects inwardly toward the inner side 170 from the lower part of the main lock portion 208. The slot runner 214 is shorter than the top end 206 of the lock 178 and fits into the slot 212 when the attachment bar 192 is inserted into the space 210 between the lock 178 and the inner side 170 of the major posterior support bar 140.

Figure 11:
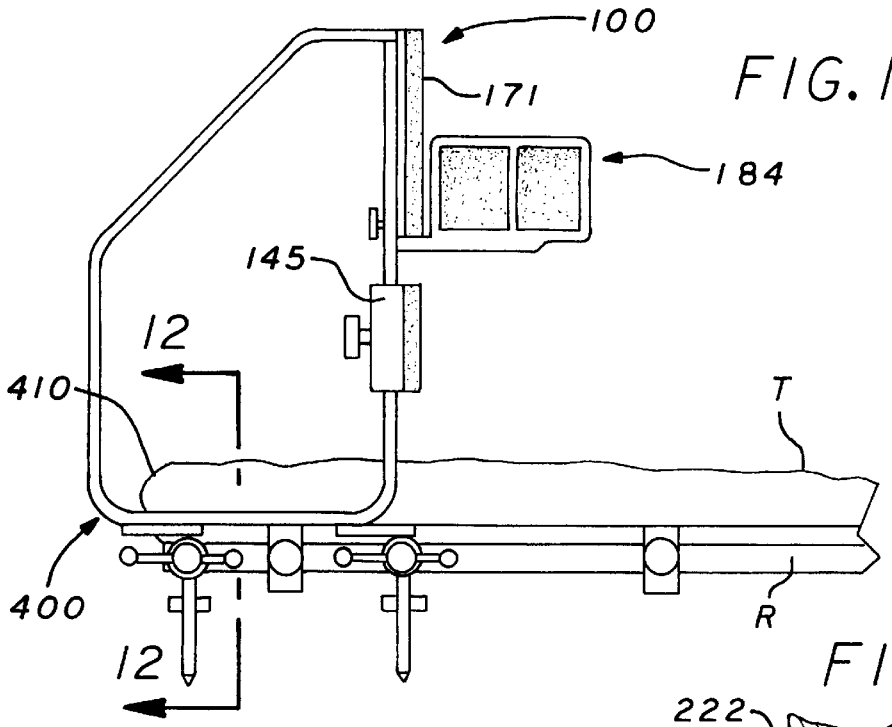
FIG. 11 is a lateral view of the adjustable surgical frame of the present invention attached to the end of a operating table.

For use during surgery, the lateral support panels 182 and 184 are inserted into the locks 178,180 so that the lateral support panels 182,184 extend from the outer side 171 of the major posterior support bar 140 with the padded side support 190 facing inwardly toward the patient as shown in FIG. 11.

The lateral support panels 182,184 of the present invention are novel in that they are self-locking as a result of the angled attachment of the side support 190 to the attachment bar 192 which orients the side support 190 in a cantilevered position with respect to the attachment bar 192. When a patient is positioned between the lateral support panels 182,184, so that the hips of the patient contact the side support 190 of the lateral support panels 182,184 a perpendicular force due to the patient's weight is exerted on the side support 190. This force causes the side support 190 to move in a direction away from the patient so that the end of the attachment bar 192 to which the transition bar 194 is attached, bends slightly in that same general direction. The attachment bar 192 is located within the lock 178 where the space between the lock 178 and the inner side 170 is just slightly greater than the width of the attachment bar 192. When the attachment bar 192 bends as a result of the force exerted by the patient on the side support 190, the attachment bar 192 contacts the inside of the lock 178 at an angle so that the attachment bar 192 jams within the lock 178 and no longer slides within the lock 178.

In addition, the major posterior support bar 140 is made of a thin, flexible material, preferably stainless steel, which is torques as force is applied by the attachment bar 192 against the lock 178. This torsion of the major posterior support bar 140 further restricts the movement of the attachment bar 192 within the lock 178 because the inner side 170 of the lower panel 162 of the major posterior support bar 140 is no longer flat, but distorted as a result of the torsion forces. The distortion of the lower panel 162 causes the space between the lock and the inner side 170 to no longer have a uniform cross section throughout and further hinders the movement of the attachment bar 192 within the lock 178. Thus, the attachment bar 192 becomes "locked" within the lock 178.

The cantilevered orientation of the side support 190 with respect to the attachment bar 192 together with the torsion of the lower panel 162 of the major posterior support bar 140 creates an instant self-locking means for locking the lateral support panels 182,184 in place as soon as the patient's hips contact the side support 190 of the lateral support panels 182,184. When the patient is no longer exerting any force on the side support 190, the attachment bar 192 is no longer bent and can again slide within the lock 178.

Once the desired position for the lateral support panels 182,184 has been attained, and the support panels 182,184 are self-locked, as a precaution the thumbscrews 186,188 are tightened to securely fix the lateral support panels 182,184 into place. Once fixed, the lateral support panels 182,184 do not move as the fit of the attachment bar 192 between the locks 178,180, and the inner side 170 is very close.

For storage or shipping purposes, the lateral support panels 182,184 are inserted into the locks 178,180 so that the lateral support panels 182,184 extend from the inner side 170 of the major posterior support bar 140 as shown in FIG. 6. In this position, the lateral support panels 182,184 project into the interior space present between the end frame members 102,104 with each of the lateral support panels 182,184 locked into its correspondingly opposite lock 180,178. When the lateral support panels 182,184 are positioned in this manner, the surgical frame 100 is more easily stored. Further, the rear cross bar 144 in addition to providing increased structural integrity to the surgical frame 100, also acts as a guide to align the lateral support panels 182,184 when they are mounted so that they extend from the inner side 170 of the major posterior support bar 140. As the pivoting legs 146,148,150,152, described in detail below, are also removable, the surgical frame 100 can be stored and transported in a conveniently modular manner without obstructing projections.

Figure 7:
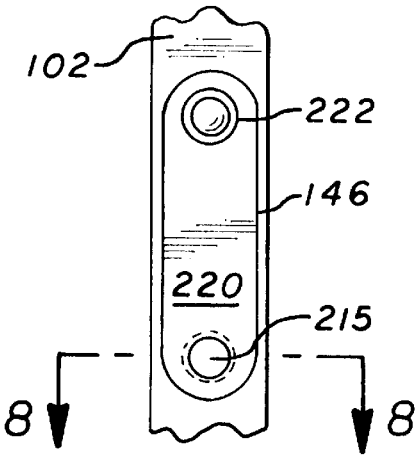
FIG. 7 is a bottom sectional view of a pivoting leg attached and parallel to the bottom of a side frame member of the adjustable surgical frame of the present invention.
Figure 9:
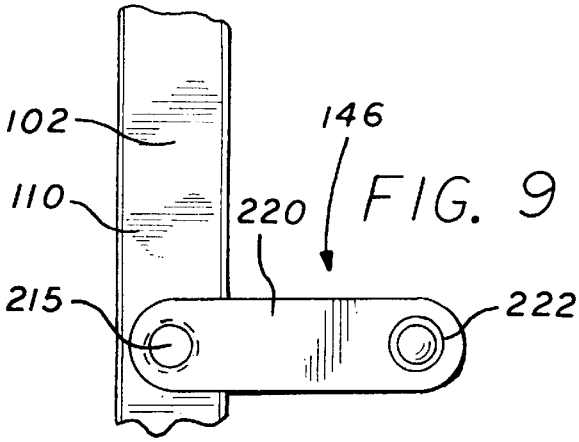
FIG. 9 is a bottom sectional view of the pivoting leg attached and perpendicular to the bottom of a side frame member of the adjustable surgical frame of the present invention.

The features of the removable pivoting legs 146,148,150, 152 are shown in detail in FIGS. 7–10. Pivoting leg 146 is identical in construction to the other legs 148,150,152 so that they are interchangeable. The pivoting leg 146 has an extension plate 220 that receives a hex bolt 215 at one end and has an attachment post 222 that projects perpendicularly from the other end of the extension plate 220. The extension plate 220 is flat and fits closely with the horizontal lower side rods 110,112 of the side frame members 102,104. In order to loosen and secure the pivoting leg 146, the hex bolt 215 attaches the extension plate 220 of the pivoting leg 146 to the bottom of the side frame members 102,104. The hex bolt 215 may be tightened or loosened by a hex key K. FIGS. 7 and 9 show the pivoting leg 146 pivoting about the central axis of the hex bolt 215 with respect to side frame member 102.

Figure 10:
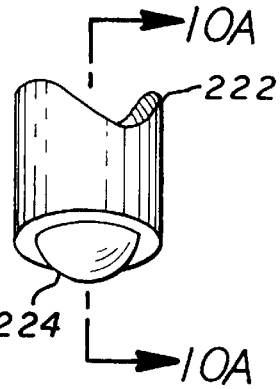
FIG. 10 is an enlarged view of the bottom tip of the pivoting leg having caster at its end.
Figure 8:
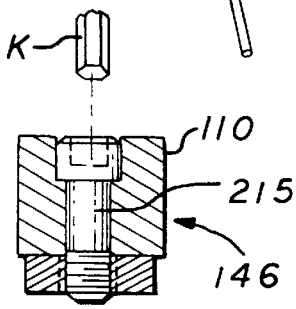
FIG. 8 is a cross section view along lines 8—8 of FIG. 7 showing the attachment of a pivoting leg to the bottom of a side frame member of the adjustable surgical frame with a hex bolt and a hex nut.
Figure 10A:
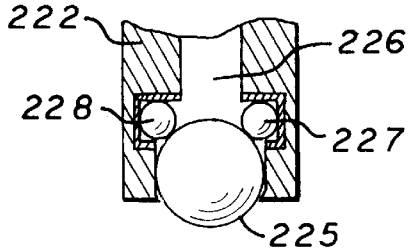
FIG. 10A is a cross sectional view along lines 1OA—10A of FIG. 10 of the caster of the pivoting leg.

In the preferred embodiment, the extension plate 220 is approximately two inches long and three quarters of an inch wide, and is made of surgical stainless steel. The attachment post 222 of the pivoting leg 146 is approximately six inches long so that it may fit within a securing device such as a universal rail clamp 300 as set forth below. As shown in FIG. 10, at the end of the attachment post 222 is a caster 224. The caster 224 articulates within the attachment post 222 so that the attachment post 222 may more easily travel over the surfaces which the caster 224 comes into contact with. As shown in FIG. 10A, the caster 224 has a ball 225 within a recess 226 surrounded by five bearings 227 located in a race 228. The ball 225 sits on the bearings 227 so that the ball 225 easily rolls within the caster 224 even in the presence of dust or wax normally found on an operating room floor.

The pivoting legs 146,148,150,152 pivot about the central axis of the hex bolt 215 to enable the surgical frame 100 to swivel in an adjustable range of positions with respect to the operating table T. As the hex bolt 215 is offset from the attachment post 222 by a distance approximately equal to the length of the extension plate 220, the surgical frame 100 may be swiveled so that it is adjustable and may be secured to a number of differing widths of operating tables. Along the sides of most modern surgical operating tables are side rails R to which a number of devices for use in surgery may be securely fixed with respect to the patient for the duration of the operation. However, not all of the side rails R of operating tables are spaced apart from each other at the same distance. The distance of the extension plate 220 on each of the pivoting legs 146,148,150,152 extends or reduces the attachment points of the side frame members 102,104 by a maximum approximately equal to the length of the extension plate 220 and any distance in between that maximum length so that the attachment points may reach the side rails R.

For example, if the surgical frame 100 were to be mounted to side rails R that are spaced apart a distance that is wider than the distance between the two side frame members 102,104, the surgical frame 100 may be pivoted about the central axis of the hex bolt 215 so that the extension plate 220 extends away from the side frame member 102 or 104 as shown in FIG. 9. In this position, the attachment post 222 reaches the side rail R and may be secured to the side rail R by a securing means such as a clamp. Depending on the distance separating the side rails R of the operating table, the surgical frame 100 may be swiveled so that the pivoting legs 146,148,150,152 on one side frame member 102 or 104 may be pivoted or the pivoting legs on both side frame members 102,104 may be pivoted to extend the extension plate 220 of all of the pivoting legs. Conversely, if the side rails R are spaced apart at a distance that is less than the distance between the side frame members 102,104, then the surgical frame 100 may be swiveled so that the extension plate 220 extends towards the interior of the surgical frame 100. If the distance between the side rails R is equal to the distance between the side frame members 102,104, then the surgical frame 100 is swiveled so that the extension plates 220 are parallel to the horizontal lower support rods 110,112 of side frame member 102,104 and the attachment posts 222 are aligned to correspond to the width of the side rails R.

It is appreciated that the length of the extension plate 220 may be varied so that the surgical frame 100 may be attached to a variety of operating tables having different widths and thus different distances separating the side rails R. It also appreciated that the attachment post 222 may be pivoted along a circle having a radius equal to the distance between the attachment post 222 and the hex bolt 215 so that it may be positioned at any angle in between the perpendicular and the parallel to the horizontal lower side rods 110,112 of the side frame members 102,104 and attach to a variety of different distances separating the side rails R. Thus, the surgical frame 100 is universally adaptable to attach to virtually any conventional operating table.

Another feature of the pivoting legs 146,148,150,152 is the ability to extend part of the surgical frame 100 off the end of an operating table. The rearmost end 400 of the surgical frame 100 may be extended beyond the edge 410 of the operating table T by swiveling the surgical frame 100 on the pivoting legs 146,148,150,152 so that the surgical frame 100 is cantilevered to extend beyond the point of attachment on the operating table a distance approximately equal to the distance between the attachment post 222 and the hex bolt 215 on the extension plate 220 as shown in FIG. 11. This arrangement, together with the 45 degree pitch of the operating table, significantly lowers the height of the patient so that the spine is at a lower height than previously possible providing a surgeon with easy access to the spine so that a supporting platform such as a stool is no longer needed by the surgeon to reach the spine of the patient.

For example, pivoting legs 146,148,150,152 having an extension plate 220 that is approximately 6 inches long may be used to cantilever the surgical frame 100 approximately 5 inches (the distance between the attachment post 222 and the hex bolt 215) from the end of the operating table T. If the operating table T is then tilted in a reverse 45 degree angle, the height of the patient P relative to the floor is lowered by approximately 5 inches as a result of the 5 inch cantilever of the surgical frame 100 in accordance with the Pythagorean theorem. It is appreciated that various pivoting legs having varying lengths of extension plates 220 may be used in order to further vary the height of the patient P when the surgical frame 100 is cantilevered from the end of an operating table T.

In addition, the attachment post 222 also serves to vary the height of the surgical frame 100 relative to the operating table to accommodate patients of different heights. For example, in the preferred embodiment the attachment post 222 is approximately six inches in length so that the surgical frame 10 may be raised from the operating table by approximately six inches for use with taller patients. Conversely, or the surgical frame 100 may be lowered so that the bottom of the side frame members 102,104 rests on the operating table for use with shorter patients. It is appreciated that the height of the surgical frame 100 may be adjusted by varying the point of attachment to the operating table T along the length of the attachment post 222 so that it is positioned at various heights relative to the surface of the operating table T.

Having set forth the elements and features of the surgical frame 100, the description of the universal rail clamp 300 as shown in FIGS. 11–15 is now set forth.

Many devices that are used in the operating room that are commonly attached to operating table side rails R have standardized components which allow some predictability with respect to the requirements necessary for a rail clamp. However, as the side rails R differ in size especially with the different operating tables used in Europe, there is a need for a clamp having a socket capable of being attached to sides rails R having a variety of different heights.

FIG. 11 shows the surgical frame 100 attached to an operating table T. As shown in FIGS. 12–15, a universal rail clamp 300 for attaching devices to the operating table T has three main portions: a crank 302, an inner rail-engaging member 304, and an outer rail-engaging member 306. The outer rail-engaging member 306 has an outer sleeve 340. The inner rail-engaging member 304 has a block 322 and a universal socket 330.

The crank 302 has a threaded bolt 310 which threads into the block 322 through threaded block hole 320. The unthreaded end 312 of the threaded bolt 310 has a hole 314 through which the shaft 315 of a handle 316 is slidably attached.

The block 322 of the inner rail-engaging member 304 has an internal instrument space 324 through which a portion of an instrument or device such as an attachment post 222 to be clamped to the side rails R may pass. The instrument space 324 is typically vertical and perpendicular to the block hole 320. The block hole 320 communicates with the instrument space 324 so that the threaded bolt 310 comes into contact with an instrument or device present in the instrument space 324.

Figure 12:
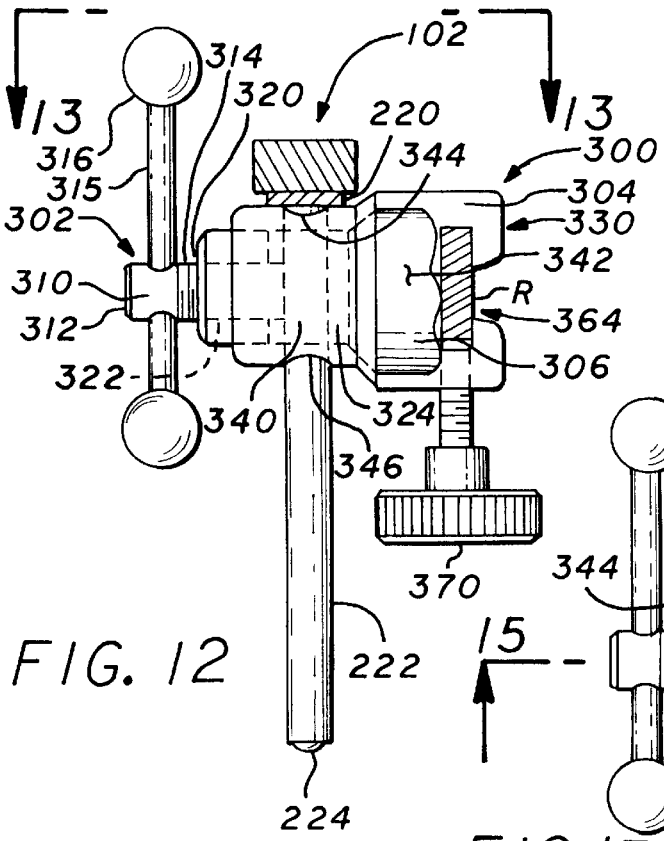
FIG. 12 is an enlarged cross sectional view along lines 12—12 of FIG. 11 showing a universal clamp attached to the side rails of an operating table and attached to a pivoting leg of the adjustable surgical frame of the present invention.
Figure 13:
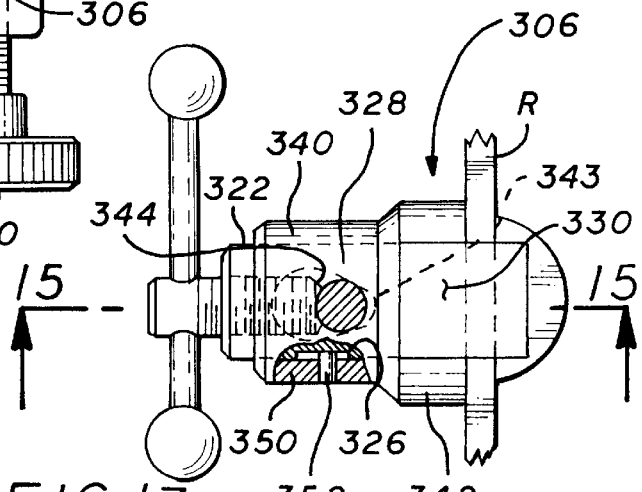
FIG. 13 is a cross sectional view of the universal clamp along lines 13—13 of FIG. 12.
Figure 14:
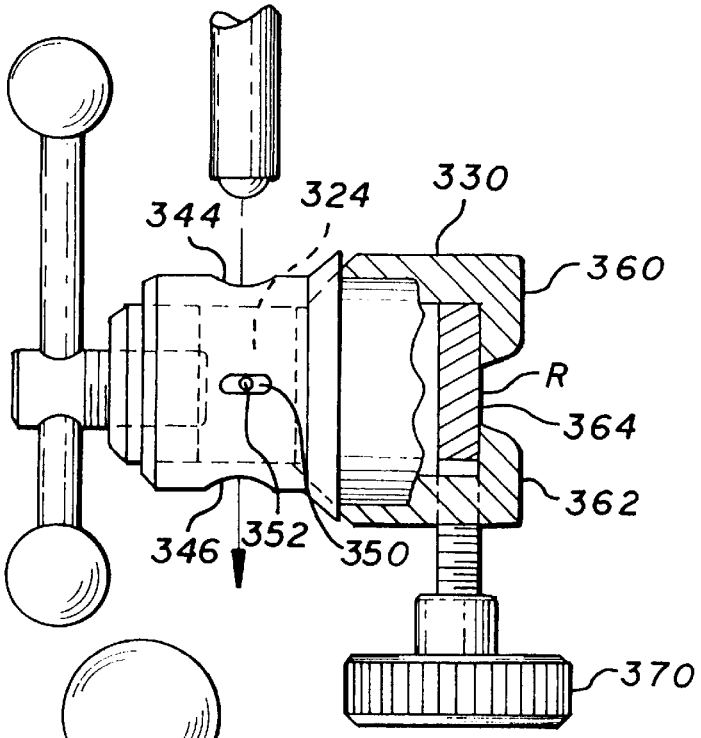
FIG. 14 is a lateral view of the universal clamp of the present invention with a partial cross section showing the attachment of the universal clamp to the side rail of an operating table and showing the direction of insertion of the attachment post of a pivoting leg.
Figure 15:
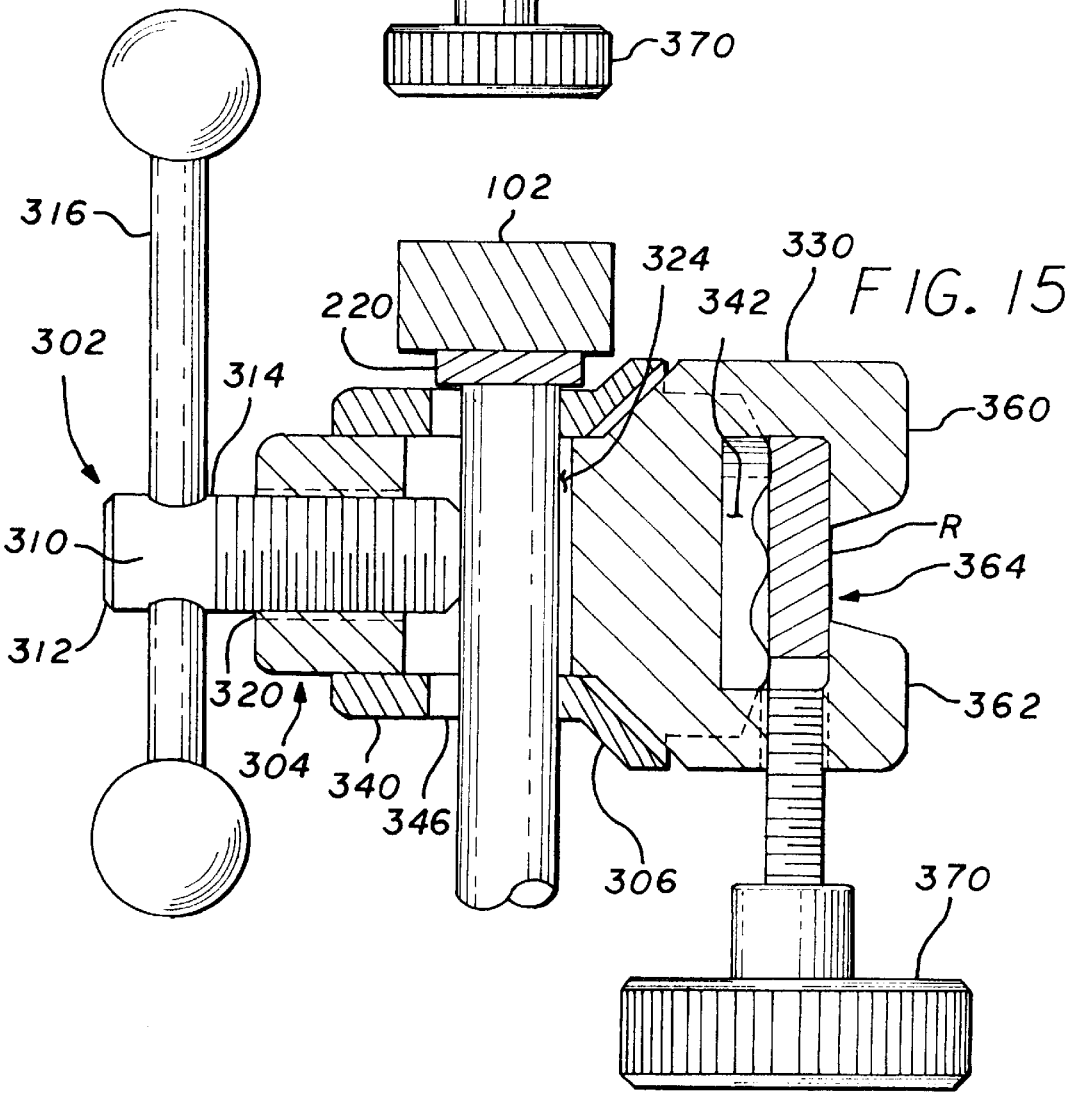
FIG. 15 is a cross sectional view along lines 15—15 of FIG. 13 of the universal clamp with the attachment post of a pivoting leg inserted into the clamp.

The outer sleeve 340 of the outer rail-engaging member 306 fits slidably over the block 322 and encloses the instrument space 324. The outer sleeve 340 has on either side of, and coaxial with the instrument space 324 two holes 344,346 through which a portion of a device (in this case the attachment post 222 of the surgical frame 100) may pass entirely through the rail clamp 300. As seen in FIGS. 12, 14, and 15, the attachment post 222 passes through the top hole 344, through the instrument space 324, and through the bottom hole 346. The diameter of the holes 344,346 is slightly smaller than the diameter of the instrument space 324 and the two holes 344,346 have rounded edges 343 for conforming to the curvature of the attachment post 222, toward the rail-engaging end of the universal rail clamp 300.

While the outer sleeve 340 encloses the instrument space 324 and surrounds a portion of the inner rail-engaging member 304, the outer sleeve 340 is not bonded or permanently affixed to the inner rail-engaging member 304 but slidably engages the inner rail-engaging member 304. The range of this sliding engagement between the outer sleeve 340 and the inner rail-engaging member 304 is determined by a channel 350 cut within the outer sleeve 340. A pin 352 descends into the channel 350 and is connected to the inner rail-engaging member 304. As the pin 352 cannot escape from the channel 350, the confinement of the pin 352 by the channel 350 also determines the sliding displacement enjoyed between the inner rail-engaging member 304 and the outer sleeve 340.

The universal socket 330 of the universal clamp 300 has an upper jaw 360 and a lower jaw 362 which are spaced apart at a predetermined and fixed distance so that the opening 364 between the two jaws is slightly smaller than the height of the smallest side rail R typically used in an operating table. In the preferred embodiment, the distance of the opening 364 between the upper jaw 360 and the lower jaw 362 is approximately 11/16 inches and ensures that once the universal socket 330 is placed on the free end of the rail R, it cannot come off at any other portion along the side rail R as the rail R cannot pass through the opening 364.

The opening 364 also permits the universal socket 330 to pass over securing pins that are typically used to secure the side rails R to the sides of an operating table. This feature permits the attachment of the universal rail clamp 300 at the free end of the side rails R after which the universal rail clamp 300 can be moved over to any location on the side rails R without being removed from the side rails R and unimpeded by the securing pins that pass through the opening 364.

When a device is passed through the universal rail clamp 300, the crank 302 is turned to tighten the universal rail clamp 300 upon the device and to secure the universal rail clamp 300 to the side rail R. As the crank 302 turns, the threaded bolt 310 descends into the threaded block hole 320 to engage the portion of the device present within the instrument space 324. As the threaded bolt 310 presses against the device portion, the device portion simultaneously presses against and pushes the outer sleeve 340 of the outer rail-engaging member 306 at the rounded edges 343 of the holes 344,346 while the threaded bolt 310 pulls on the block 322 of the inner rail-engaging member 304. As the side rail R is located between the inner 304 and outer 306 rail-engaging members, the tightening of the threaded bolt 310 causes an excursion of the outer sleeve 340 toward the side rail R and compresses the side rail R between the inner 304 and outer 306 rail-engaging members. In this way, a very secure attachment is achieved between the device and the universal rail clamp 300 as well as between the universal rail clamp 300 and the side rail R. The device portion is securely entrapped between the threaded bolt 310 and the outer sleeve 340 of the outer rail-engaging member 306. The side rail R is securely entrapped between the inner 304 and outer 306 rail-engaging members.

The height of the surgical frame 100 can be further adjusted by inserting only a portion of the attachment post 222 through the instrument space 324 universal rail clamp 300 to keep the surgical frame 100 positioned relatively high on the operating table T. If it is desired to lower the surgical frame 100, a larger portion of the attachment post 222 may be inserted through the instrument space 324 of the universal rail clamp 300.

If it is desired to keep the universal rail clamp 300 fixed to the side rail R after the universal clamp 300 is untightened so that the side rail R is no longer securely entrapped between the inner 304 and outer 30 rail-engaging members, a thumbscrew 370 which is threaded into the lower jaw 362 may be tightened to firmly engage the side rail R against the upper jaw 360 of the universal socket 330 and the end of the thumbscrew 370. The thumb screw 370 may be used to position the universal clamp 300 at a desired location on the side rails R prior to inserting a device portion or the attachment post 222 of one of the pivoting legs 146,148, 150,152.

While the present invention has been described in detail with regards to the preferred embodiment, it is appreciated that other variations of the present invention may be devised which do not depart from the inventive concept of the present invention.

What is claimed is:

1. An adjustable surgical frame for supporting a patient during spinal surgery on an operating table having side rails, comprising:

first and second side frame members each comprising a forward vertical member and a bottom horizontal member, said first and said second side frame members set apart in a parallel relationship;

means for supporting the posterior of the patient;

a plurality of pivoting legs pivotally attached to each of said first and said second side frame members, the position of said pivoting legs being movable relative to said first and said second side frame members;

said first and said second side frame members comprising a top horizontal member parallel to said bottom horizontal member, a rearward vertical member parallel to said forward vertical member, and an angled rearward member connected to said top horizontal member and connected to said rear vertical member.

2. The adjustable surgical frame of claim 1 in which said means for supporting the posterior of the patient includes at least one major posterior support member connected and extending from said first side frame member to said second side frame member at said forward vertical members.

3. The adjustable surgical frame of claim 1 further comprising an adjustable minor posterior support member slideably connected to said forward vertical members of said first and said second side frame members, said adjustable minor support member capable of being fixed at any position along said forward vertical members.

4. The adjustable surgical frame of claim 1 further comprising means for removably mounting the adjustable surgical frame to a variety of conventional operating tables having different widths and different distances between the side rails.

5. The adjustable surgical frame of claim 1 including means for adjusting the height of said adjustable surgical frame relative to the surface of an operating table.

6. An adjustable surgical frame for supporting a patient during spinal surgery on an operating table having side rails, comprising:

first and second side frame members each comprising a forward vertical member and a bottom horizontal member, said first and said second side frame members set apart in a parallel relationship;

means for supporting the posterior of the patient;

a plurality of pivoting legs pivotally attached to each of said first and said second frame members;

a pair of lateral support panels for supporting the hips of a patient on the adjustable surgical frame, said lateral panels extending from said forward vertical member for supporting the sides of a patient's hips;

said lateral support panels comprising a side support member, an attachment bar, and a transition bar attaching said side support member at an angle to said attachment bar.

7. The adjustable surgical frame of claim 6 in which said pair of lateral support panels include a self-locking means.

8. The adjustable surgical frame of claim 7 in which said self-locking means comprises a pair of locks positioned on said major posterior support member, each of said pair of locks having means for receiving and holding said attachment bar, said attachment bar being slideably inserted within said means for receiving and holding.

9. An adjustable surgical frame for supporting a patient during spinal surgery on an operating table having side rails, comprising:

first and second side frame members each comprising a forward vertical member and a bottom horizontal member, said first and said second side frame members set apart in a parallel relationship;

means for supporting the posterior of the patient;

a plurality of pivoting legs pivotally attached to each of said first and said second frame members, said plurality of pivoting legs each including an extension plate, each said extension plate includes means for pivotally attaching each said extension plate to one of said first and said second side frame members and an attachment post, said means for pivotally attaching being offset from said attachment post along said extension plate.

10. The adjustable surgical frame of claim 9 in which the position of said attachment post relative to said first and said second side frame members is changed by pivoting said extension plate about said means for pivotally attaching.

11. The adjustable surgical frame of claim 9 in which each of said plurality of pivoting legs includes a caster means at the end of each said attachment posts for rollably moving said adjustable surgical frame.

12. An adjustable surgical frame for supporting a patient during spinal surgery on an operating table having side rails, comprising:

first and second side frame members each comprising a forward vertical member and a bottom horizontal member, said first and said second side frame members set apart in a parallel relationship, said first and said second side frame members further comprising a top horizontal member parallel to said bottom horizontal member, a rearward vertical member parallel to said forward vertical member, an angled rearward member connected to said top horizontal member and connected to said rear vertical member;

at least one major posterior support member connected and extending from said first side frame member to said second side frame member at said forward vertical members;

a plurality of legs extending downward from said bottom horizontal members, said legs being pivotably attached to said bottom horizontal members; and a plurality of universal rail clamps for removably mounting the surgical frame to a variety of conventional operating tables having different widths and different sized side rails.

13. An adjustable surgical frame for supporting a patient during spinal surgery on an operating table having side rails, comprising:

first and second side frame members each comprising a forward vertical member and a bottom horizontal member, said bottom horizontal member being substantially shorter than said forward vertical member said first and said second side frame members set apart in a parallel relationship;

at least one major posterior support member connected and extending from said first side frame member to said second side frame member at said forward vertical members;

a plurality of legs extending downward from said bottom horizontal members;

a plurality of universal rail clamps for removably mounting the surgical frame to a variety of conventional operating tables having different widths and different sized side rails;

a pair of lateral support panels for supporting the hips of a patient on the adjustable surgical frame, said lateral panels extending from said major posterior support member for supporting the sides of a patient's hips;

said lateral support panels comprising a side support member, an attachment bar, and a transition bar attaching said side support member at an angle to said attachment bar.

14. The adjustable surgical frame of claim 13 in which said pair of lateral support panels include a self-locking means.

15. The adjustable surgical frame of claim 14 in which said self-locking means comprises a pair of locks positioned on said major posterior support member, each of said pair of locks having means for receiving and holding said attachment bar, said attachment bar being slideably inserted within said means for receiving and holding.

16. An adjustable surgical frame for supporting a patient during spinal surgery on an operating table having side rails comprising:

first and second side frame members each comprising a closed loop having a forward vertical member and a bottom horizontal member, said first and said second side frame members set apart in a parallel relationship, said first and said second side frame members further comprising a top horizontal member parallel to said bottom horizontal member, a rearward vertical member parallel to said forward vertical member, an angled rearward member connected to said top horizontal member and connected to said rear vertical member;

at least one major posterior support member connected and extending from said first said side frame member to said second side frame member at said forward vertical members;

an adjustable minor posterior support member slideably connected to said forward vertical members of said first and said second side frame members, said adjustable minor support member capable of being fixed at any position along said forward vertical members;

a plurality of pivoting legs pivotally attached to said first and said second side frame members, said pivoting legs extending downward from said bottom horizontal members, said legs being pivotably attached to said bottom horizontal members; and a plurality of universal rail clamps for removably mounting the adjustable surgical frame to a variety of conventional operating tables having different widths and different sized side rails.

17. An adjustable surgical frame for supporting a patient during spinal surgery on an operating table having side rails, comprising:

first and second side frame members each comprising a closed loop having a forward vertical member and a bottom horizontal member, said first and said second side frame members set apart in a parallel relationship;

at least one major posterior support member connected and extending from said first said side frame member to said second side frame member at said forward vertical members;

an adjustable minor posterior support member slideably connected to said forward vertical members of said first and said second side frame members, said adjustable minor support member capable of being fixed at any position along said forward vertical members;

a plurality of pivoting legs Pivotally attached to said first and said second side frame members, said pivoting legs extending downward from said bottom horizontal members;

a plurality of universal rail clamps for removably mounting the adjustable surgical frame to a variety of conventional operating tables having different widths and different sized side rails;

a means for adjusting the height of said adjustable surgical frame relative to the surface of an operating table;

a pair of lateral support panels for supporting the hips of a patient on the adjustable surgical frame, said lateral panels extending from said major posterior support member for supporting the sides of a patient's hips;

said lateral support panels comprising a side support member, an attachment bar, and a transition bar attaching said side support member at an angle to said attachment bar.

18. The adjustable surgical frame of claim 17 in which said pair of lateral support panels include a self-locking means.

19. The adjustable surgical frame of claim 18 in which said self-locking means comprises a pair of locks positioned on said major posterior support member, each of said pair of locks having means for receiving and holding said attachment bar, said attachment bar being slideably inserted within said means for receiving and holding.

20. An adjustable surgical frame for supporting a patient during spinal surgery on an operating table having side rails, comprising:

first and second side frame members each comprising a forward vertical member and a bottom horizontal member, said first and said second side frame members set apart in a parallel relationship;

at least one major posterior support member connected and extending from said first side frame member to said second side frame member at said forward vertical members;

a plurality of legs extending downward from said bottom horizontal members, said legs being pivotably attached to said bottom horizontal members, said plurality of pivoting legs each including an extension plate; and a plurality of universal rail clamps for removably mounting the surgical frame to a variety of conventional operating tables having different widths and different sized side rails.

21. The adjustable surgical frame of claim 20 in which each of said plurality of pivoting legs includes a caster means at the end of each said attachment posts for rollably moving said adjustable surgical frame.

22. A surgical frame for supporting a patient during spinal surgery on an operating table, comprising:

first and second side frame members each comprising a closed loop having a forward vertical member, a bottom horizontal member, a top horizontal member parallel to said bottom horizontal member, a rearward vertical member parallel to said forward vertical member, an angled rearward member connected to said top horizontal member and connected to said rear vertical member, said first and said second side frame members set apart in a parallel relationship;

at least one major posterior support member connected to said first and said second side frame members at said forward vertical members;

a pair of lateral support panels for supporting the hips of a patient on the surgical frame, said lateral panels extending from said major posterior support member for supporting the sides of a patient's hips; said lateral support panels comprising a side support member, an attachment bar, and a transition bar attaching said side support member at an angle to said attachment bar.

23. The surgical frame of claim 22 in which said pair of lateral support panels include a self-locking means.

24. The surgical frame of claim 23 in which said self-locking means comprises a pair of locks positioned on said major posterior support member, each of said pair of locks having means for receiving and holding said attachment bar, said attachment bar being slideably inserted within said means for receiving and holding.

* * * * *